US007540405B2

(12) United States Patent
Sase et al.

(10) Patent No.: US 7,540,405 B2
(45) Date of Patent: Jun. 2, 2009

(54) PAPER CONTAINER FOR FLUID HAVING SPOUT PLUG

(75) Inventors: Kazuhiko Sase, Tokyo (JP); Susumu Onodera, Tokyo (JP); Kenji Tanaka, Tokyo (JP); Shigekazu Miyagawa, Tokyo (JP); Eiichi Asoi, Tokyo (JP)

(73) Assignee: Nippon Paper-Pak Co., Ltd., Tokyo (JP)

( * ) Notice: Subject to any disclaimer, the term of this patent is extended or adjusted under 35 U.S.C. 154(b) by 605 days.

(21) Appl. No.: 10/555,764

(22) PCT Filed: Apr. 23, 2004

(86) PCT No.: PCT/JP2004/005849

§ 371 (c)(1),
(2), (4) Date: Nov. 7, 2005

(87) PCT Pub. No.: WO2004/099025

PCT Pub. Date: Nov. 18, 2004

(65) Prior Publication Data

US 2007/0040009 A1 Feb. 22, 2007

(30) Foreign Application Priority Data

May 9, 2003 (JP) ..... 2003-131293

(51) Int. Cl.
*B65D 43/00* (2006.01)
*B67D 5/00* (2006.01)
*B65D 17/42* (2006.01)

(52) U.S. Cl. ..... 229/125.14; 229/125.15; 222/83; 220/277

(58) Field of Classification Search ..... 229/125, 229/125.14, 125.09, 125.15, 125.17, 248, 229/125.04, 204; 222/541.2, 541.7, 541.9, 222/80, 81, 83, 83.5, 88; 220/277
See application file for complete search history.

(56) References Cited

U.S. PATENT DOCUMENTS 4,483,464 A * 11/1984 Nomura ..... 222/83
5,141,133 A * 8/1992 Ninomiya et al. ..... 222/83
5,297,696 A * 3/1994 Bernstein et al. ..... 222/83

(Continued)

FOREIGN PATENT DOCUMENTS

JP 2000-344261 12/2000

(Continued)

*Primary Examiner*—Gary E Elkins
*Assistant Examiner*—Latrice Byrd
(74) *Attorney, Agent, or Firm*—Wenderoth, Lind & Ponack, L.L.P.

(57) ABSTRACT

A paper container for fluid including a spout plug, in which the spout plug is formed of a spout positioned on a spout hole part for cutting and opening and incorporates a rotary opening blade and a cap. The spout plug is fitted to a top panel, which includes the spout hole part for cutting and opening in which a spout hole is formed in a paper base material and is sealed by a sealing layer. The contained further including a cut and opened piece fall prevention mechanism produced when the sealing layer is cut and opened by the rotary opening blade of the spout plug and capable of preventing a part of the cut and opened piece of the sealing layer from being cut off and giving hinge function to the uncut part of the cut and opened piece in the spout hole part for cutting and opening.

4 Claims, 6 Drawing Sheets

U.S. PATENT DOCUMENTS 5,325,983 A * 7/1994 Imai et al. ..... 220/277
5,366,114 A * 11/1994 Bernstein et al. ..... 222/83
5,482,176 A * 1/1996 Maietta et al. ..... 220/277
5,960,992 A * 10/1999 Bernstein et al. ..... 222/83.5
6,041,968 A * 3/2000 Weiteder ..... 222/83
6,216,945 B1 * 4/2001 Gabrielli et al. ..... 229/204
6,398,075 B1 * 6/2002 Laciacera et al. ..... 222/91
6,536,627 B1 * 3/2003 Benoit-Gonin et al. ..... 222/83
7,225,947 B2 * 6/2007 Leuenberger et al. ..... 222/83

FOREIGN PATENT DOCUMENTS

WO 03/002419 1/2003

* cited by examiner

PAPER CONTAINER FOR FLUID HAVING SPOUT PLUG

TECHNICAL FIELD

The present invention relates to a paper container for fluid having a spout plug in which the spout plug formed of a spout being positioned on a spout hole part for cutting and opening and incorporating a rotary opening blade and a cap, is fitted to a top panel having the spout hole part for cutting and opening, in which a spout hole formed in a paper base material is sealed by a sealing layer, in which the sealing layer sealing the spout hole is cut and opened by the rotary opening blade.

BACKGROUND ART

Conventionally, due to its ease of fluid pouring, paper containers have been widely used for fluid having a spout plug. The spout plug is formed from a spout being positioned on a spout hole part for cutting and opening and incorporating an opening blade and a cap, and is fitted to a top panel having the spout hole part for cutting and opening. A spout hole formed in a paper base material is sealed by a sealing layer, in which the sealing layer sealing the spout hole is cut and opened by the opening blade.

As examples of such a paper container for fluid having a spout plug have been proposed for a number of containers equipped with a cut and opened piece fall prevention mechanism for preventing the cut and opened piece of the sealing layer from falling into the container, since the cut and open piece of the sealing layer is produced when the sealing layer of the spout hole part is cut and opened by the opening blade of the spout plug.

In most cases, the cut and opened piece fall prevention mechanism is provided in the spout plug. In a known example of such a paper container for fluid having a spout plug, the opening blade incorporated in the spout of the spout plug is of a rotary type, and the cut and opened piece fall prevention mechanism is a rotation regulating portion effecting regulation such that the rotation angle of the opening blade in the cutting the sealing layer is less than 360 degrees. Thereby making it possible to effect cutting while leaving a part of the cut and opened piece uncut (see, for example, WO 03/002419).

In another known paper container for fluid having a spout plug, the opening blade incorporated in the spout of the spout plug is of a push-in type, and the cut and opened piece fall prevention mechanism is provided a blade-less portion in a part of the opening blade. Thereby making it possible to effect cutting while leaving a part of the cut and opened piece uncut (see JP 10-194276 A).

Most of the paper containers for fluid having a spout plug formed of a spout incorporating an opening blade and a cap as described above, are gable top type paper containers for fluid, adopted as paper containers for fluid for accommodating contents having a relatively short preservation period. Recently, however, from the viewpoint of ease of pouring, aseptic (germ-free) filling type and brick type paper containers for fluid for accommodating contents having a relatively long preservation period (hereinafter referred to as aseptic/brick type paper containers for fluid) have also come to be required to be equipped with a spout plug formed of a spout containing an opening blade and a cap.

However, in a paper container for fluid for accommodating contents having a long preservation period, the sealing layer is thicker than that of a paper container for fluid for accommodating contents having a short preservation period in order to maintain the long-period preservation property for the contents. As a result, with the opening blade incorporated in the spout of the spout plug, as disclosed in WO 03/002419, which is regulated such that the rotation angle for cutting the sealing layer is less than 360 degrees, the cutting property is rather insufficient, and the cutting is difficult to perform. With the push-in type opening blade contained in the spout of the spout plug as disclosed in JP 10-194276 A, which is regarded as inferior to the rotary type opening blade in terms of cutting property, the cutting is still more difficult to perform.

It has been found through experimentation that this problem can be solved by adopting as the opening blade, a rotary type opening blade, which is superior to the push-in type opening blade in terms of cutting/opening property, and setting the rotation angle of the opening blade in cutting the opened piece to be 360 degrees or more. However, this results in a problem in that the cut and opened piece produced when effecting cutting and opening with the opening blade is cut completely and falls into the container to be mixed into the contents as foreign matter.

SUMMARY OF THE INVENTION

It is an object of the present invention to provide a paper container for fluid having a spout plug and a sealing layer that can be cut easily and reliably by the opening blade of the spout plug, leaving an uncut part, thereby making it possible to prevent the cut and opened piece from falling into the container and clogging the spout hole.

The object of the present invention is attained by providing a paper container for fluid having a spout plug in which the spout plug is formed of a spout positioned on a spout hole part for cutting and opening and incorporating a rotary opening blade and a cap, and is fitted to a top panel having the spout hole part for cutting and opening. The spout hole is formed in a paper base material and sealed by a sealing layer, characterized by including a cut and opened piece fall prevention mechanism for leaving, in the spout hole part for cutting and opening, uncut a part of the cut and opened piece produced when the sealing layer is cut and opened by the rotary opening blade of the spout plug and for endowing the uncut part of the cut and opened piece with a hinge function.

In this embodiment, when opening the spout hole part for cutting and opening, cutting is effected by rotating the rotary opening blade of the spout plug by 360 degrees or more, whereby it is possible to effect opening easily and reliably even when the sealing layer is thick. Further, in the spout hole part for cutting and opening, there is provided a cut and opened piece fall prevention mechanism by which a part of the cut and opened piece produced when the sealing layer is cut and opened by the rotary opening blade of the spout plug is left uncut and is endowed with a hinge function, so that the cut and opened piece is prevented from falling into the container, and the uncut part is pressed to be bent by the rotary opening blade, with the uncut part being used as a hinge, whereby it is possible to prevent the spout hole from being clogged by the cut and opened piece.

Further, the cut and opened piece fall prevention mechanism is provided on the paper container side, and there is no need to provide a cut and opened piece fall prevention mechanism in the spout plug, so that the construction of the spout plug is simplified, which makes the production of the paper container so much easier and helps to achieve a reduction in cost.

It is preferable that the cut and opened piece fall prevention mechanism provided in the spout hole part for cutting and opening be formed of a protrusion which is provided on a part of the periphery of the spout hole provided in the paper base material and which protrudes into the spout hole.

In this embodiment, when opening the spout hole part for cutting and opening, the rotating rotary opening blade runs on the protrusion protruding from a part of the periphery of the spout hole provided in the paper base material into the spout hole, whereby the protrusion remains as an uncut part and is pushed to be bent, so that it is possible to prevent the cut and opened piece of the sealing layer cut by the rotary opening blade from falling into the container. Further, since the cut and opened piece connected to the protrusion is in a bent state, it is possible to prevent the spout hole from being clogged by the cut and opened piece. Further, since the construction of the cut and opened piece fall prevention mechanism is simple, the production of the container is facilitated, thereby achieving a reduction in cost.

It is preferable that the hinge portion be formed at a base portion of the protrusion by piercing or half-cutting or creasing the paper base material along all or a part of a line connecting portions near the ends of the base portion of the protrusion.

In this embodiment, the hinge portion is formed at the base portion of the protrusion, so that, when the rotary opening blade runs on the protrusion, the protrusion is easily bent starting with the hinge portion, whereby the rotary opening blade glides on the upper surface of the protrusion, and the force applied to the protrusion is dispersed. Thus, there is no fear of the protrusion being damaged, and it is possible to reliably leave an uncut part in a part of the cut and opened piece of the sealing layer. Further, the protrusion may be easily pressed to be bent starting with the hinge portion formed at the base portion thereof by the rotary opening blade running on the upper surface thereof, so that the cut and opened piece connected to the protrusion is also brought into a bent state, and the spout hole is prevented from being clogged by the cut and opened piece.

It is preferable that the radius of a cutting line of the rotary opening blade of the spout plug mounted onto the spout hole part for cutting and opening provided in the top panel be smaller than the radius of the spout hole provided in the paper base material, and be larger than the distal end of the protrusion protruding into the spout hole.

In this embodiment, when opening the spout hole part for cutting and opening, the rotating rotary blade can reliably run on the protrusion, whereby it is possible to reliably leave an uncut part in a part of the cut and opened piece of the sealing layer.

DETAILED DESCRIPTION OF THE INVENTION

Figure 1:
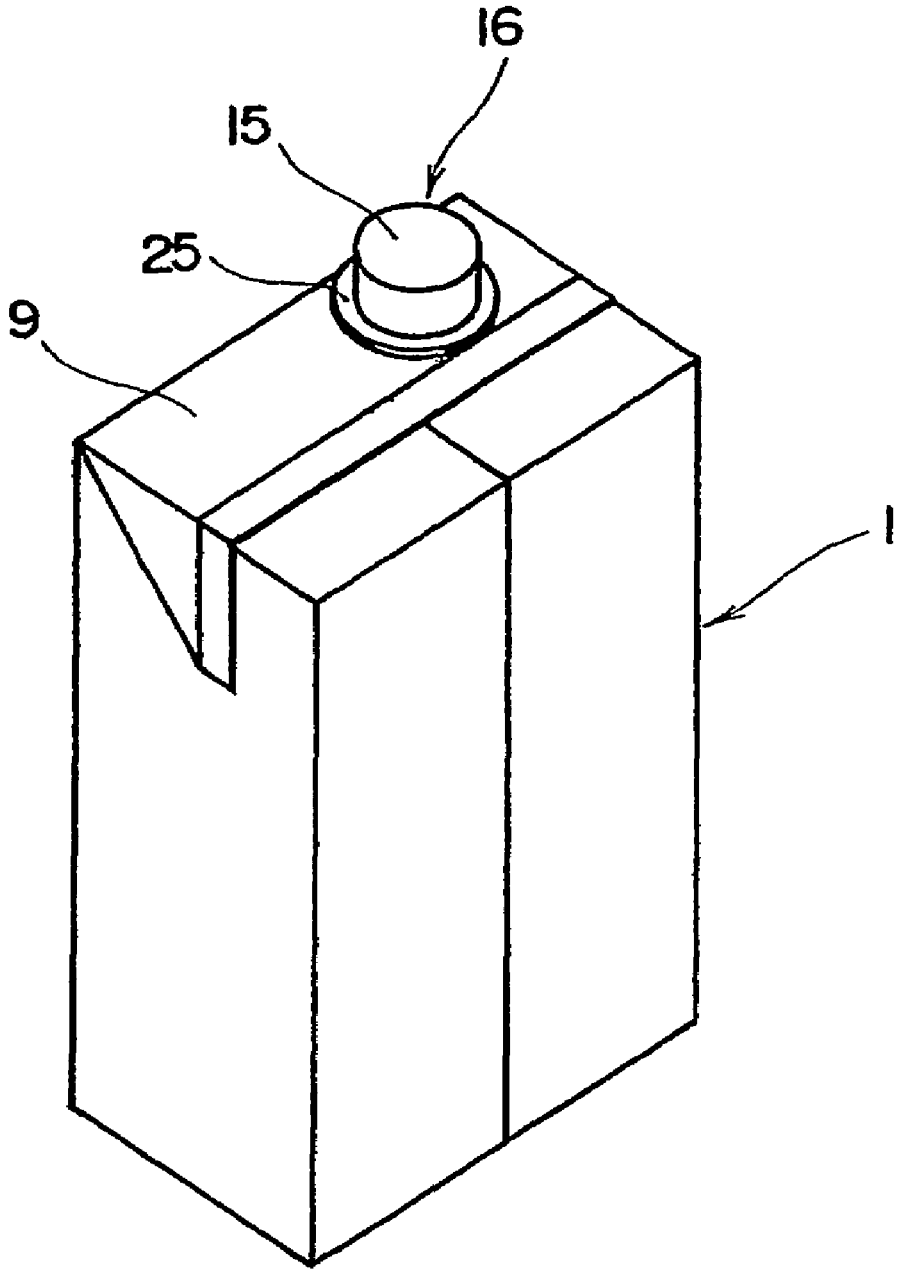
FIG. 1 is a perspective view of a paper container for fluid having a spout plug according to an embodiment of the present invention.
Figure 2:
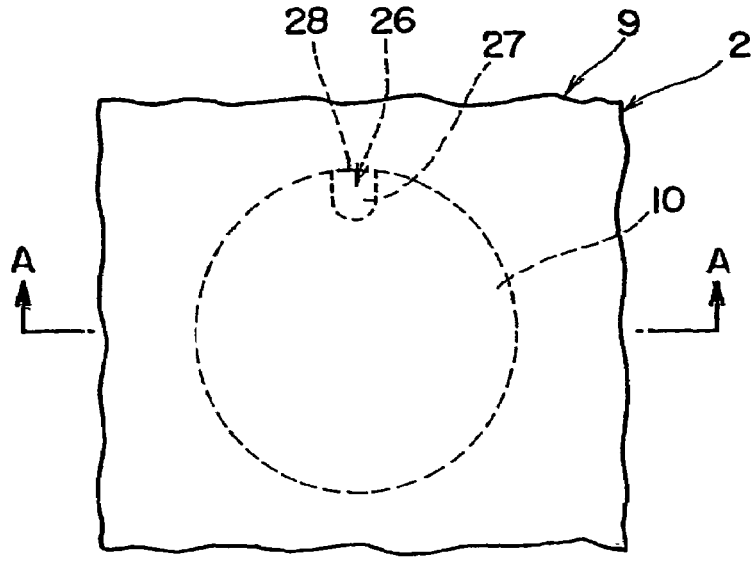
FIG. 2 is an enlarged plan view of a spout hole part for cutting and opening provided in a top panel.

Embodiments of the present invention will be described in more detail with reference to the accompanying drawings.

FIGS. 1 through 8 show a paper container for fluid having a spout plug according to an embodiment of the present invention.

In the figures, reference numeral 1 indicates a container main body, which is not different from that of a well-known paper container for fluid. In this embodiment, it is a brick type container, and is formed of a container material 2 shown in FIG. 3.

Figure 3:
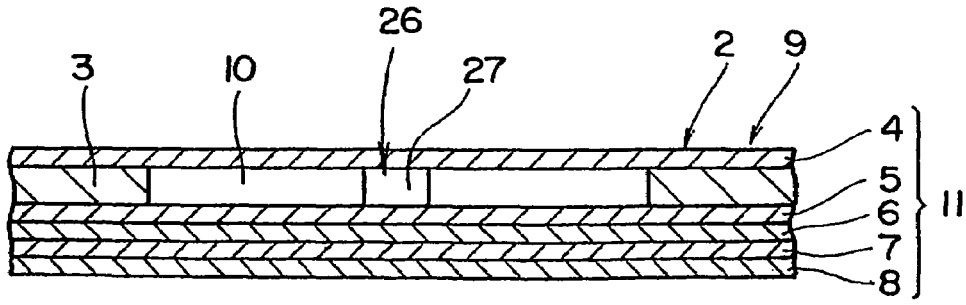
FIG. 3 is a sectional view taken along a line A-A of FIG. 2.
Figure 4:
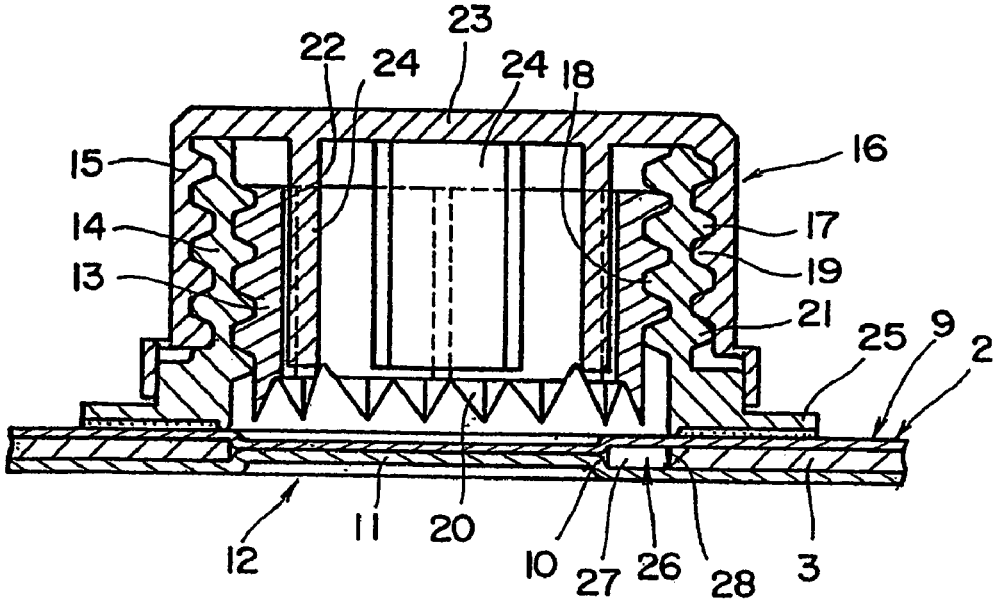
FIG. 4 is a longitudinal sectional view of a spout plug mounted to the spout hole part for cutting and opening.

More specifically, as shown in FIG. 3, on the front surface of the paper base material 3, there is stacked a thermoplastic resin layer 4 formed of a low density polyethylene; on the back surface of the paper base material, there are stacked a thermoplastic resin layer 5 formed of a low-density polyethylene, a barrier layer 6, a thermoplastic resin layer 7 formed of a thermally adhesive resin, and a thermoplastic resin layer 8 formed of a low density polyethylene, in the stated order from the back surface side of the paper base material 3. While in this embodiment an aluminum foil is stacked as the barrier layer 6, it is also possible to use, instead of an aluminum foil, a barrier deposition layer, a barrier coating layer, a barrier resin layer, etc.

In a top panel 9 of the container main body 1 formed of the container material 2, there is provided a spout hole part for cutting and opening 12 in which a spout hole 10 provided in the paper base material 3 is sealed by a sealing layer 11. In this embodiment, the sealing layer 11 sealing the spout hole 10 provided in the paper base material 3 and constituting the spout hole part for cutting and opening 12 is constructed of the thermoplastic resin layer 4 formed of a low density polyethylene, the thermoplastic resin layer 5 formed of a low-density polyethylene, the barrier layer 6, the thermoplastic resin layer 7 formed of a thermally adhesive resin, and the thermoplastic resin layer 8 formed of a low density polyethylene, which are stacked on the front and back surfaces of the paper base material 3 to form the container material 2. However, it is also possible, for example, to provide the sealing layer by gluing a laminate sheet to the back surface of the spout hole.

In FIG. 3, inside the spout hole 10 provided in the paper base material 3, illustrates a space between the thermoplastic resin layer 4 stacked on the front surface side, and the thermoplastic resin layer 5, the barrier layer 6, the thermoplastic resin layer 7 and the thermoplastic resin layer 8 stacked on the back surface side. However, this space is only given for the sake of convenience in order to make the figure easier to understand. In some embodiments, the thermoplastic resin layer 4 stacked on the front surface side, and the thermoplastic resin layer 5, the barrier layer 6, the thermoplastic resin layer 7 and the thermoplastic resin layer 8 stacked on the back surface side, are integrally stacked together within the spout hole 10 to form the sealing layer 11.

Mounted to the top panel 9 is a spout plug 16 situated on the spout hole part for cutting and opening 12 and composed of a spout 14 incorporating a rotary cutting blade 13 and a cap 15. The spout plug 16 has, on the inner and outer peripheral surfaces of the spout 14, screw portions 17, 18 inclined in opposite directions; and the cap 15 has, on the inner peripheral surface thereof, a screw portion 19 to be threadingly engaged with the screw portion 17, and is threadingly engaged with the outer periphery of the spout 14.

The rotary opening blade 13 has comb-teeth-like edge portions 20 at the lower end of a cylindrical body whose diameter is set smaller than at least the diameter of the spout hole 10 provided in the paper base material 3; further, on the outer peripheral surface thereof, it has a screw portion 21 to be threadingly engaged with the screw portion 18 on the inner peripheral surface of the spout 14, and is threadingly engaged with the inner periphery of the spout 14. In the inner peripheral surface of the rotary opening blade 13, there is formed a key groove 22 in the axial direction and, on the inner peripheral surface of a top plate 23 of the cap 15, there is provided a key 24 which is engaged so as to be axially slidable with respect to the key groove 22 formed in the inner peripheral surface of the rotary opening blade 13 to transmit the rotation of the cap 15 to the rotary opening blade 13.

Figure 8:
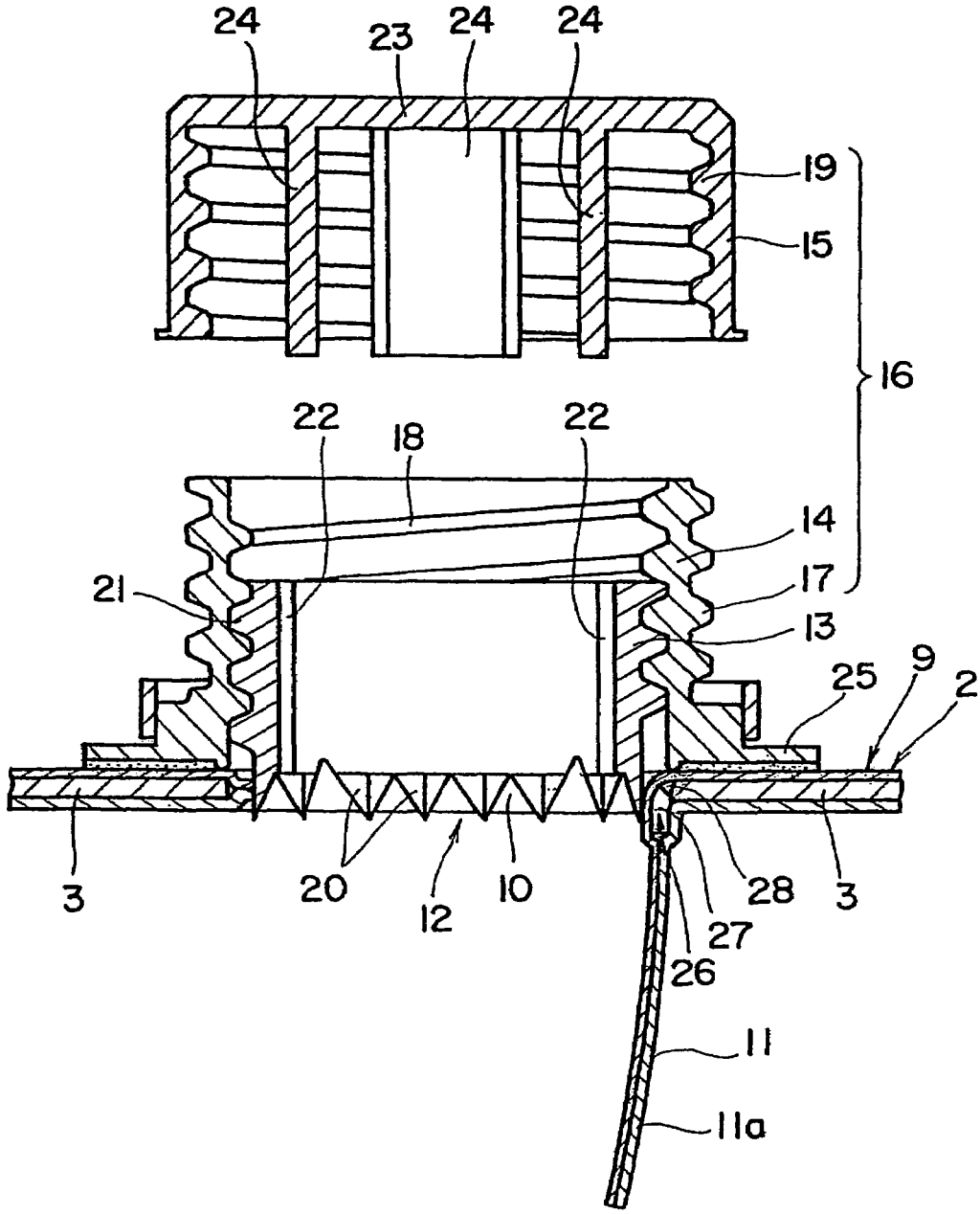
FIG. 8 is an explanatory longitudinal sectional view showing the spout hole part for cutting and opening in an opened state.

Further, the cap 15 and the rotary opening blade 13 are set such that, when the cap 15 is threadingly engaged with the spout 14, the rotary opening blade 13 is situated inside the spout 14 along with the edge portions 20 thereof (see FIG. 4); when the cap 15 is turned so as to be detached from the spout 14, the rotary opening blade 13 rotates, and moves in a direction opposite to the cap 15; when the cap 15 is detached from the spout 14, the edge portions 20 of the rotary opening blade 13 protrude outwardly to a sufficient degree from the lower end of the spout 14 (see FIG. 8).

A flange portion 25 is formed on the outer periphery of the lower end of the spout 14, and fusion is effected, with the flange portion 25 situated on the spout hole part for cutting and opening 12, thereby mounting the spout plug 16 to the top panel 9. The mounting is effected such that the spout hole 10 provided in the paper base material 3 and the rotary opening blade 13 formed of a cylindrical body are situated coaxially with respect to each other.

The rotary opening blade 13 of the spout plug 16 is composed of a thermoplastic resin formed of polypropylene, the spout 14 is formed of a thermoplastic resin formed of a low density polyethylene, and the cap 15 is composed of a thermoplastic resin formed of a high density polyethylene.

In the spout hole part for cutting and opening 12, to which the spout plug 16 is mounted, there is provided a cut and opened piece fall prevention mechanism 26 which leaves uncut a part of a cut and opened piece 11*a* produced when the sealing layer 11 is cut and opened by the rotary opening blade 13 of the spout plug 16, and which endows the uncut part of a cut and opened piece 11*a* with a hinge function.

In this embodiment, a protrusion 27 protruding into the spout hole 10 is formed on a part of the periphery of the spout hole 10 provided in the paper base material 3, and the protrusion 27 serves as the cut and opened piece fall prevention mechanism 26 provided in the spout hole part for cutting and opening 12.

The protrusion 27 has a width W and a protrusion length L which secure a sufficient fluid pouring opening due to the cut and opened piece 11*a* that has been cut, and is not cut by the rotary opening blade 13; further, it is easily bent by the rotary opening blade 13 running thereon, with the rotary opening blade gliding on the upper surface of the protrusion to disperse the force applied to the protrusion and avoid cutting.

The radius of the cutting line C of the rotary opening blade 13 of the spout plug 16 situated in the spout hole 10 in which the protrusion 27 is formed must be smaller than the radius of the spout hole 10 and larger than the distal end portion of the protrusion 27 protruding into the spout hole 10. In particular, it is desirable for the cutting line C of the rotary opening blade 13 to strike a portion near the center in the protruding direction of the protrusion 27 protruding into the spout hole 10. If the cutting line C strikes a portion near the base portion of the protrusion 27 protruding into the spout hole 10, a cutting force is strongly exerted, and the protrusion 27 may be cut from the base portion. If the cutting line C strikes a portion near the distal end of the protrusion 27 protruding into the spout hole 10, the rotary opening blade 13 may glide past the distal end without running on the protrusion 27 to cut the sealing layer, with the result that the cut and opened piece fall prevention mechanism 26 fails to function as such.

Figure 5:
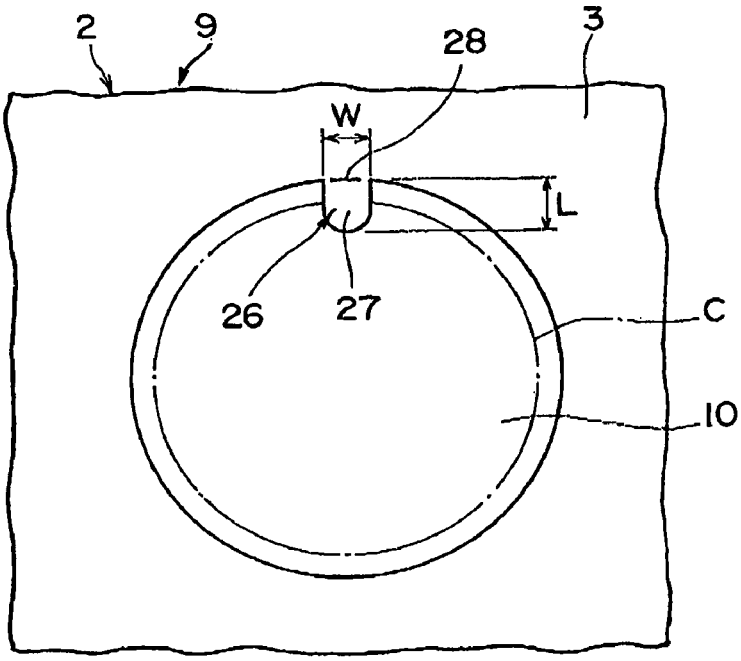
FIG. 5 is an explanatory view of the spout hole part for cutting and opening provided on the top panel and the spout plug.

In this embodiment, the width W of the protrusion 27 as measured as the distance between the ends of a portion near the base portion is 5 mm, and the protrusion length L thereof as measured from the periphery of the spout hole 10 is 5 mm so that the cutting line C of the rotary cutting blade 13 may strike a position of the protrusion 27 approximately 2 mm from the base portion thereof (see FIG. 5).

Figure 6:
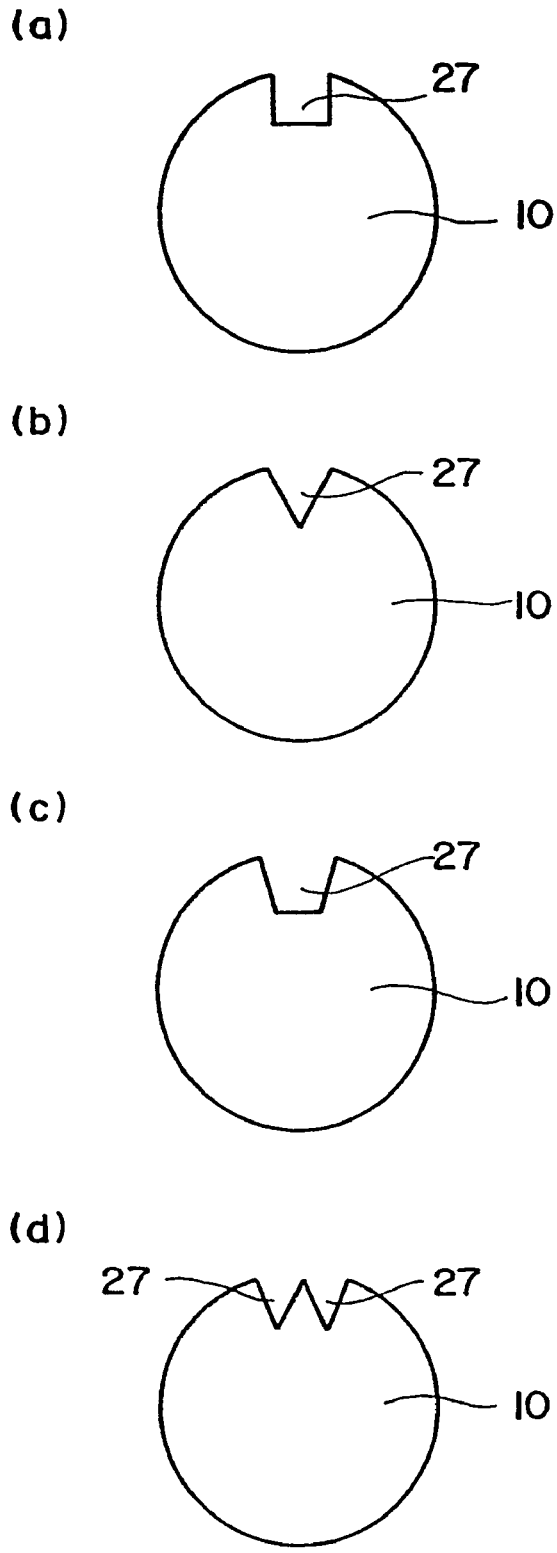
FIGS. 6(*a*), 6(*b*), 6(*c*), and 6(*d*) are explanatory views showing configurations of spout holes provided in a paper base material according to the embodiment of the present invention.

Further, there are no particular limitations regarding the configuration of the protrusion 27 as long as it secures a sufficient fluid pouring opening due to the cut and opened piece 11*a* that has been cut, and exhibits a hinge function by which it is bent by the rotary opening blade 13 running thereon without being cut by the rotary opening blade 13. For example, the protrusion may be rectangular as shown in FIG. 6(*a*), V-shaped as shown in FIG. 6(*b*), or trapezoidal as shown in FIG. 6(*c*), or plural as shown in FIG. 6(*d*).

Figure 7:
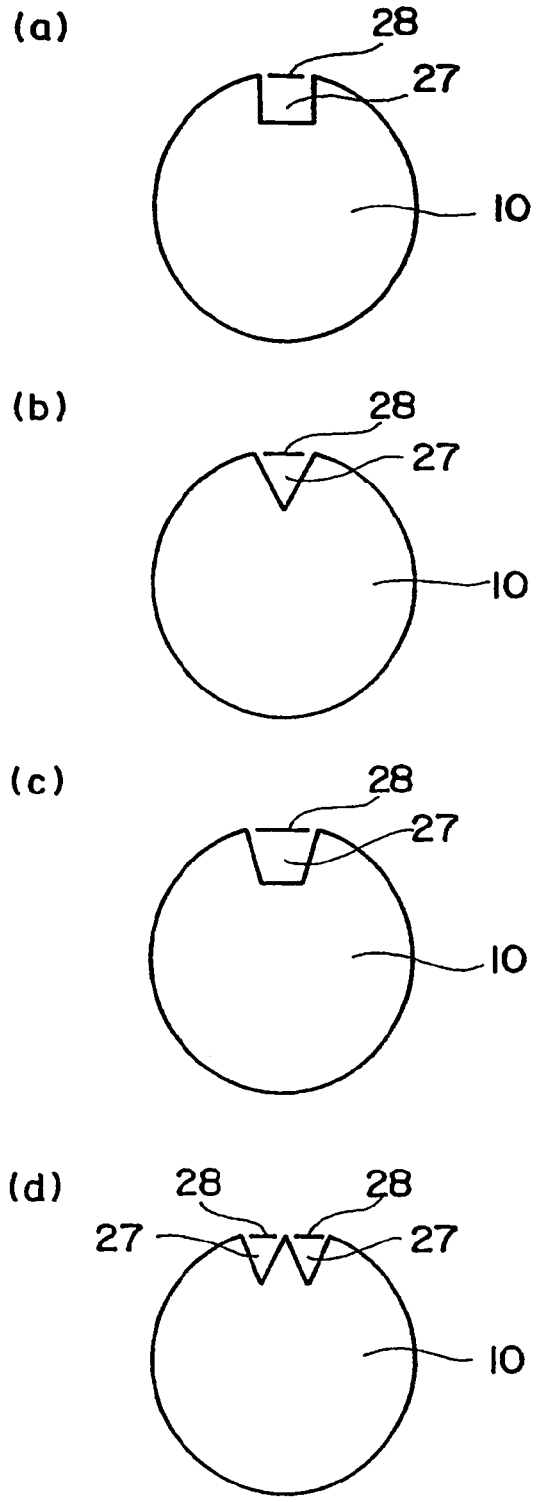
FIGS. 7(*a*), 7(*b*), 7(*c*), and 7(*d*) are explanatory views showing other examples of configurations of spout holes provided in a paper base material according to the embodiment of the present invention.

Further, as shown in FIG. 7, to make the protrusion 27 easier to bend, there may be formed a hinge portion 28 by piercing the paper base material 3 along all or a part of a line connecting portions near the ends of the base portion of the protrusion 27, or by a half-cut notch or a creased line. In this embodiment, the hinge portion 28 is formed at the base portion of the protrusion 27.

In the paper container for fluid having a spout plug, constructed as described above, when, in opening the spout hole part for cutting and opening 12, the cap 15 of the spout plug 16 is rotated, the rotary opening blade 13 descends while rotating with the rotation of the cap 15, and cuts the sealing layer 11 sealing the spout hole 10 provided in the paper base material 3 forming the spout hole part for cutting and opening 12. The cutting of the sealing layer 11 is effected with the edge portions 20 while the rotary opening blade 13 rotates by 360 degrees or more, so that even if the sealing layer 11 sealing the spout hole 10 is thick, the cutting and opening can be effected easily and reliably. Further, the spout hole part for cutting and opening 12 is provided with the cut and opened piece fall prevention mechanism 26 for leaving uncut a part of the cut and opened piece 11*a* produced when the sealing layer 11 is cut and opened by the rotary opening blade 13 of the spout plug 16 and for endowing the uncut part of the cut and opened piece 11*a* with a hinge function, so that it is possible to prevent the cut and opened piece 11*a* from falling into the container 1, and the cut and opened piece 11*a* is pressed to be bent by the rotary opening blade 13 using the uncut part as a hinge, making it possible to prevent the spout hole 10 from being clogged by the cut and opened piece 11*a*.

In this embodiment, as the cut and opened piece fall prevention mechanism 26 provided in the spout hole part for cutting and opening 12, there are provided, on a part of the periphery of the spout hole 10 provided in the paper base material 3, the protrusion 27 protruding into the spout hole 10 and, at the base portion of the protrusion 27, the hinge portion 28 by piercing the paper base material along all or a part of a line connecting portions near the ends of the base portion of the protrusion 27, or by a half-cut notch or a creased line. Due to this arrangement, when opening the spout hole part for cutting and opening 12, the rotating rotary opening blade 13 runs on the protrusion 27, with the result that the portion concerned remains as an uncut part, making it possible to reliably prevent the cut and opened piece 11*a* of the sealing layer 11 obtained through cutting by the rotary opening blade 13 from falling into the container 1.

Further, when the rotary opening blade 13 contacts the protrusion 27, the protrusion 27 is easily bent starting with the hinge portion 28, whereby the rotary opening blade 13 glides on the upper surface of the protrusion 27, and the cutting force applied to the protrusion 27 is dispersed, so that it is unlikely that the protrusion 27 will be damaged, and it is possible to reliably leave an uncut part in a part of the cut and opened piece 11*a* of the sealing layer 11. Further, the protrusion 27 is pressed to be bent starting with the hinge portion 28 formed at the base portion thereof by the rotary opening blade 13 running thereon, so that the cut and opened piece 11*a*, connected to the protrusion 27, is also brought into a bent state, thereby preventing the spout hole 10 from being clogged by the cut and opened piece 11*a*.

Further, in this embodiment, the radius of the cutting line C of the rotary opening blade 13 of the spout plug 16 is set larger than the radius of the spout hole 10 and larger than the distal end portion of the protrusion 27, so that when opening the spout hole part for cutting and opening 12, the rotating rotary opening blade 13 can reliably run on the protrusion 27, whereby it is possible to reliably leave an uncut part in a part of the cut and opened piece 11*a* of the sealing layer 11.

As described above, according to the present invention, a paper container for fluid having a spout plug in which the spout plug formed of a spout positioned on a spout hole part for cutting and opening and incorporating a rotary opening blade and a cap, is fitted to a top panel having the spout hole part for cutting and opening, in which a spout hole formed in a paper base material is sealed by a sealing layer, characterized by including a cut and opened piece fall prevention mechanism for leaving, in the spout hole part for cutting and opening, uncut a part of a cut and opened piece produced when the sealing layer is cut and opened by the rotary opening blade of the spout plug and for endowing the uncut part of a cut and opened piece with a hinge function. Therefore, when opening the spout hole part for cutting and opening, cutting is effected by rotating the rotary opening blade of the spout plug by 360 degrees or more, whereby it is possible to effect opening easily and reliably even when the sealing layer is thick. Further, in the spout hole part for cutting and opening, there is provided a cut and opened piece fall prevention mechanism by which a part of the cut and opened piece produced when the sealing layer is cut and opened by the rotary opening blade of the spout plug is left uncut and is endowed with a hinge function, so that the cut and opened piece is prevented from falling into the container, and the uncut part is pressed to be bent by the rotary opening blade, with the uncut part being used as a hinge, thereby preventing the spout hole from being clogged by the cut and opened piece. Further, the cut and opened piece fall prevention mechanism is provided on the paper container side, and there is no need to provide a cut and opened piece fall prevention mechanism in the spout plug, so that the construction of the spout plug is simplified, which makes the production of the paper container so much easier and helps to achieve a reduction in cost.

The invention claimed is:

1. A paper container for fluids, comprising;

a spout plug including a spout positioned on a spout hole part configured to be cut and opened, a rotary opening blade and a cap, the spout plug being fitted to a top panel having the spout hole part;

a spout hole formed in a paper base material sealed by the spout hole part, said spout hole part formed by a material other than said paper based material; and a cut and opened piece fall prevention mechanism provided in the spout hole part for leaving uncut a part of the spout hole part, said cut and opened piece fall prevention mechanism produced when the spout hole part is cut and opened by the rotary opening blade of the spout plug and for endowing the uncut part of said spout hole part with a hinge function, wherein the cut and opened piece fall prevention mechanism provided in the spout hole part is formed of a protrusion which is provided on a part of a periphery of the spout hole formed in the paper base material and which protrudes into the spout hole by extending the paper base material.

2. A paper container for fluid having a spout plug according to claim 1, wherein the hinge portion is formed at a base portion of the protrusion by piercing or half-cutting or creasing the paper base material along all or a part of a line connecting portions near the ends of the base portion of the protrusion.

3. A paper container for fluid having a spout plug according to claim 1, wherein a radius of a cutting line of a rotary opening blade of the spout plug mounted onto the spout hole part provided in the top panel is smaller than a radius of the spout hole provided in the paper base material, and is larger than the distal end of the protrusion protruding into the spout hole.

4. A paper container for fluid having a spout plug according to claim 2, wherein a radius of a cutting line of a rotary opening blade of the spout plug mounted onto the spout hole part provided in the top panel is smaller than a radius of the spout hole provided in the paper base material, and is larger than the distal end of the protrusion protruding into the spout hole.

* * * * *